United States Patent [19]

Tuomaala

[11] Patent Number: 4,458,567

[45] Date of Patent: Jul. 10, 1984

[54] METHOD FOR ORIENTING A LOG

[75] Inventor: Jorma A. K. Tuomaala, Karhula, Finland

[73] Assignee: A. Ahlstrom Osakeyhtio, Noormarkku, Finland

[21] Appl. No.: 376,029

[22] Filed: May 7, 1982

[30] Foreign Application Priority Data

May 29, 1981 [FI] Finland ..... 811655

[51] Int. Cl.[3] ..... B27B 31/06

[52] U.S. Cl. ..... 83/13; 83/367; 83/706; 83/708; 83/520; 144/378

[58] Field of Search ..... 83/520, 521, 708–712, 83/706, 367; 144/378; 198/395; 358/93, 101; 250/560, 561

[56] References Cited

U.S. PATENT DOCUMENTS

| | | | |
|---|---|---|---|
| 1,804,764 | 5/1931 | Grant | 83/521 X |
| 3,560,096 | 2/1971 | Watson et al. | 83/520 X |
| 3,963,938 | 6/1976 | Sanglert | 144/378 X |
| 4,240,477 | 12/1980 | Horn et al. | 144/378 X |
| 4,316,491 | 2/1982 | Kearnes et al. | 83/367 X |
| 4,365,704 | 12/1982 | Stenvall | 83/367 X |
| 4,383,561 | 5/1983 | Gregoire et al. | 83/367 X |

*Primary Examiner*—Frank T. Yost

*Attorney, Agent, or Firm*—Bucknam and Archer

[57] ABSTRACT

A method for orienting a log, supported by rotating means, which is to be fed into a saw or a similar device. The upper edge line of the log profile is surveyed by two cameras placed in such a symmetrical position above the log that a line from the camera to the log in the feed plane forms an olbique angle with the feed plane. Each camera records the edge line viewed by it and the log is brought by orienting movements in such a position that the images of the edge lines as viewed by the cameras are substantially mirror images of each other.

6 Claims, 4 Drawing Figures

METHOD FOR ORIENTING A LOG

PRIOR ART STATEMENT

The closest prior art of which we are aware is disclosed in the Finnish patent application No. 783677. The relevance of this disclosure appears from the specification.

The present invention relates to a method for orienting a log to be fed into a saw or a similar device. It is essential at the first sawing stage of a round log that the finished sides of the created cant are as equal as possible. In order to achieve this the log must be rotated to such a position that its axis aligns all through its length as accurately as possible with the axis of the sawing line. As the saw blades are vertical the crooked-growth of the log must be directed either upwards or downwards and the log must lie in the middle of the sawing line.

The form and position of the log in relation to the sawing line can be measured by several different methods. Based on these measurements the optimum position of the log and the displacement required to obtain the position can be calculated. Obtaining the optimum position, however, is very difficult for two reasons. The form of the log often deviates much from a cone frustum crooked in one direction. Calculating the optimum position becomes complex and requires extensive data processing. Secondly, achieving the optimum position presupposes that the displacement is carried out accurately according to the computed coordinates which is possible only if the log is arrested in the orienting device both during the measurement and the displacement. The log can not e.g. be rotated on conventional orienting rollers as deviation of the log cross section from a circle causes remarkable lateral movements.

The Finnish patent application No. 783677 discloses a method for orienting a log to be fed in a saw in a manner by which the crooked-growth of the log is directed upwards, where the top surface of the log is illuminated and two cameras are used to measure the angle between the line passing through the outermost point of the illuminated surface and the camera, and the center line of the camera. The log is rotated and rotation is stopped when the angles measured by the cameras are equal and their sum in its maximum. A disadvantage of this arrangement is its sensibility to deformity of the log.

The purpose of the method according to the invention is to avoid the disadvantages of the prior art. Its greatest advantage is accurate measurements irrespective of deformity of the log. In the orienting method of the invention the size or form of the log is in no phase determined. The optimum position and the extent of the orienting movements are not calculated. Throughout the orienting process the measurement and calculation give an unambiguous instruction on the direction of the orienting movement, instead. Orienting can be carried out by conventional orienting rollers. Each orienting movement is continued until the sign of the instruction on the direction of the orienting movement is changed.

Figure 1:
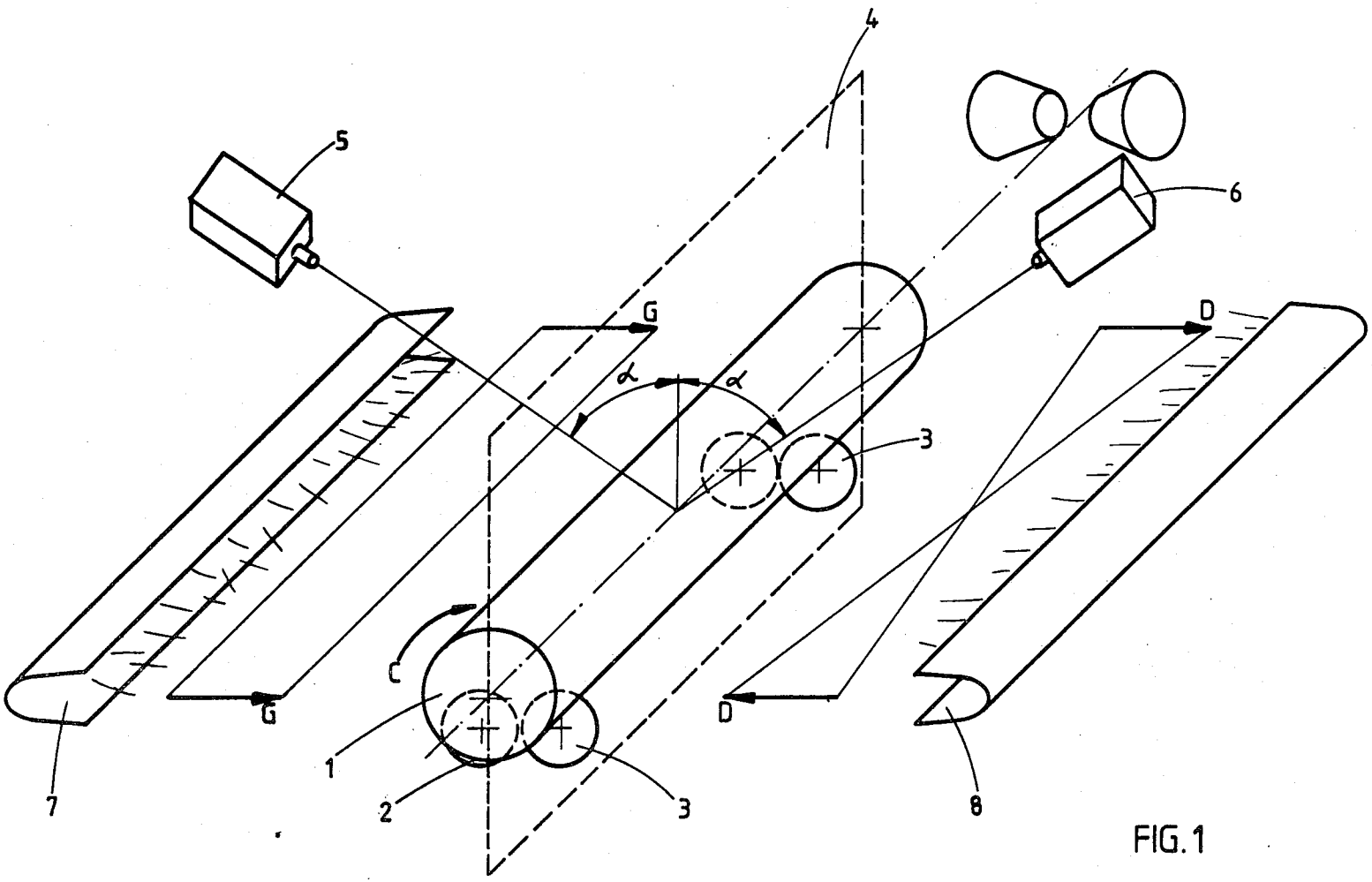
Figure 2:
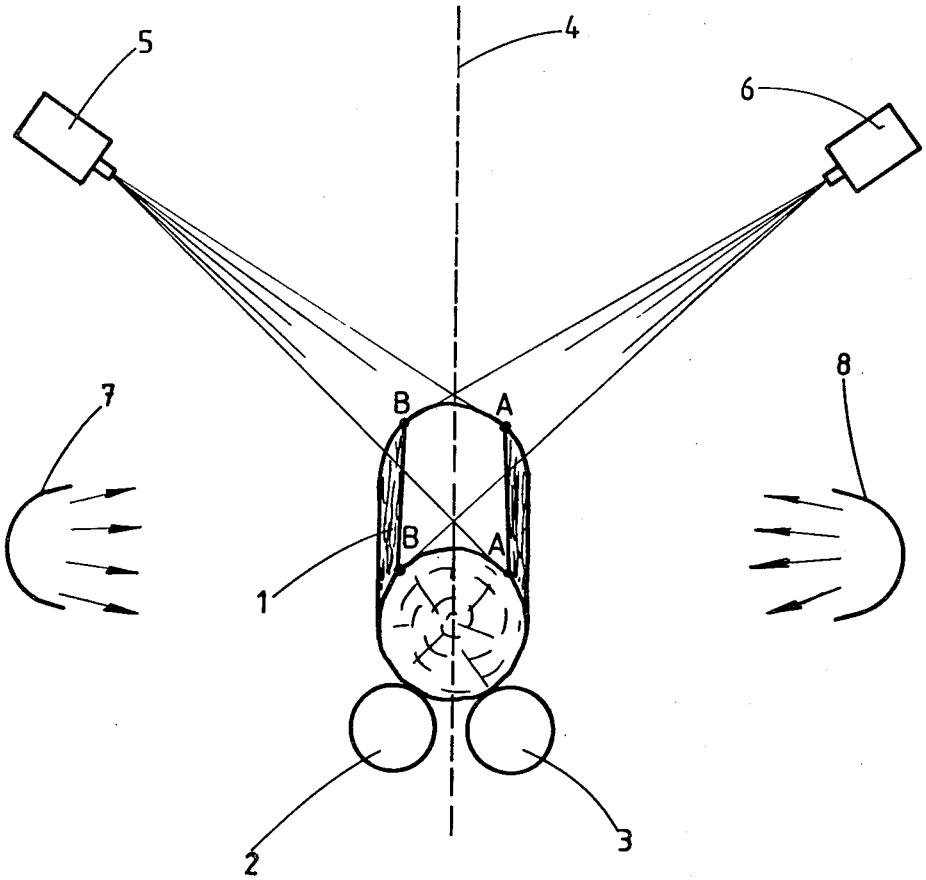
Figure 3:
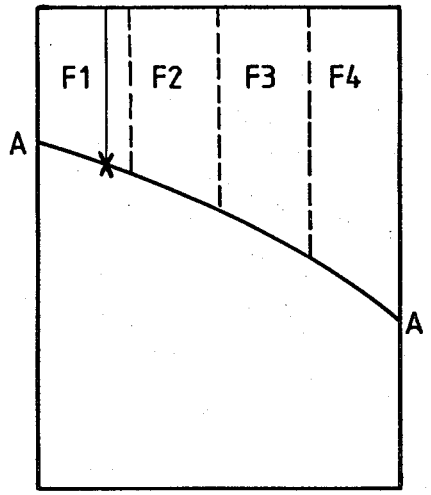
Figure 4:
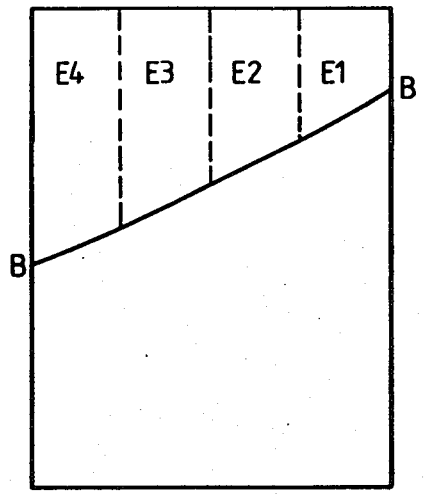

The invention is described in more detail below with reference to the accompanying drawings where FIG. 1 is a perspective view of the principle of the method according to the invention in schematic representation, FIG. 2 is a view generally similar to the one in FIG. 1 but seen in the direction of the sawing line and FIGS. 3 and 4 are the views seen by the cameras.

In FIG. 1 a log 1 is represented on orienting rollers 2 and 3 in a feed plane 4. The feed plane is a plane which passes through the sawing line and is parallel to the sawing blades. Before starting the feed the log should be placed so that its center-of-gravity axis coincides with the feed plane as accurately as possible. As the feed plane is in general vertical the crooked-growth of the log should be directed up or down and the log should otherwise lie in the middle of the feed plane. To achieve this, the log can be rotated on the orienting rollers; furthermore the log can be turned and displaced by movements of the orienting rollers transverse to the feed plane. The meaning and the positive directions of these orienting movements are illustrated in FIG. 1 where arrow C indicates the positive direction of rotating, arrow D the positive direction of turning and arrow G the positive direction of displacement.

Two measuring cameras 5 and 6, matrix or video cameras, are placed in such a symmetrical position above the log that a line from the camera to the log in the feed plane forms an oblique angle $\alpha$ of about 55° C. with the feed plane. The upper surface of the log is strongly lit e.g. by two light sources 7 and 8 placed on both sides of the log. The camera is placed in such a position that e.g. 5 m of the log starting from close the top is included in the image field. The camera starts scanning from the edge of the image field and meets the edge line of the strongly illuminated log. The length of the scan line from the edge of the image field to the image of the edge line of the log is registered in a computer. Thus the cameras are recording each for its side the upper edge line of the log, only. The edge line A—A in FIG. 2 is viewed by the left camera 5 and the edge line B—B by the right camera 6. FIG. 3 illustrates the image of the edge line taken by the left camera and FIG. 4 the one taken by the right camera. An equal amount of scan lines appr. 300, are recorded along the log on both sides. These lines are divided in four equal groups and each line group is assigned a store location, F1, F2, F3 and F4 for the left and E1, E2, E3 and E4 for the right, correspondingly. These store locations are refilled e.g. 25 times per second. The directions of the required orienting movements are determined by the contents of these store locations, only. In general it is advantageous to direct the crooked-growth upwards. It is easy to deduct that this is achieved when the upwards directed curvature of the log edge line in both image fields is equal. The position of the log in lateral direction does not effect the result. As rotation of the log changes its position in lateral direction, this orienting must be carried out first.

The curvature of the edge line can be calculated from the following rotation functions irrespective of the inclination or position of the curve: left image field $F1+F4-F2-F3$ and right image field $E1+E4-E2-E3$. If e.g. the curvature given by the left camera is smaller than the one given by the right camera the required orienting movement is rotation in a direction marked positive in FIG. 1. The store locations of both cameras are purged, refilled and the necessary rotation direction is determined e.g. 25 times per second. Rotation is continued until the order of magnitude of the functions is changed at which time the rotation is stopped.

In the next stage the need to turn the log is checked by the turning function $F2+F3+F4-3\times F1$ on the left and $E2+E3+E4-3\times E1$ on the right. The turning functions illustrate the curvature of the edge line in the image field. If the function given by the left camera is greater than the one given by the right camera, turning is to be carried out in the positive direction. Turning does not effect the rotation functions.

Lastly, the log must be positioned in the lateral direction.

The displacement function of the left camera is F1+F2+F3+F4 and the one of the right camera E1+E2+E3+E4, correspondingly. The displacement functions illustrate the position of the edge curve in the image. If the left function is greater displacement is to be carried out in the positive direction. The displacement does not effect the mutual relations of the turning and rotation functions. The required lateral movements can be minimized by displacing in the turning phase the top or the base of the log according to its effect on the balance of the displacement functions.

The advantages of this orienting method are obvious. As the direction of the required orienting movements is always known the extent of the orienting movements is small and the time they require is short, e.g. the maximum rotation required is half a turn.

When sawing small logs the orienting rollers are bound to be seen and registered as form of the log. Also the pliers of the log carriage feeding the previous log may as moving objects be included in the image field. These disturbances do affect the orienting functions but as they are in a symmetrical position to the feed plane they do not affect the balance of the orienting functions and thus the orienting accuracy remains unaffected.

When a narrowing lens (Cinemascope) is disposed in front of the objectives of the cameras, the cameras can be brought closer to the log and the frames can be used more effectively thus increasing the orienting accuracy. The same effect, however, is gained in a more effective and simple way by using a cylindrical mirror. Then the log is projected in a distorted length but even this does not reduced the orienting accuracy.

When the orienting is completed the log lies as accurately as possible in the feed plane with the crooked-growth upwards. If the cameras are so placed that the whole length of the upper edge of the log profile is seen in the image field the length of the log can be registered by the number of the scan lines received for calculation. Furthermore, as the position of the orienting rollers is known, it is possible to determine by the orienting functions with reasonable accuracy also the diameter, conicality and crookedness of the log. In this way the data of the log to be registered for sawing is gained without a separate measuring and registration station.

The image areas limited by the edge lines may be divided also in other ways than in the embodiment examples of FIGS. 3 and 4 in equal portions whereby the functions, based on which the orienting movement or movements are carried out, are changed.

In the following claims the positive direction of the curvature of the log edge line means that the center of the edge line is curved higher up in the image field than the ends of the line.

The specific embodiment shown is not meant to limit the scope of the claim and is only one of several which could have been employed.

What we claim is:

1. A method for orienting a log to be fed into a saw or a similar device, said log being supported by rotating means in a sawing line, comprising the steps of:

(a) placing cameras above the log such that they are symmetrical with respect to the log and that a line from each camera to the log in a feed plane which passes through the sawing line and is parallel to the blades of said device forms an oblique angle with said feed plane;

(b) recording with each camera the upper edge line of the log profile viewed by it;

(c) moving the log into such a position that the edge lines as used by the cameras are substantially mirror images of each other.

2. A method according to claim 1, further comprising directing the crooked-growth of the log upward by rotating the log in such a direction that the difference between the curvature of the edge line diminishes and the curvature of both the edge lines becomes positive.

3. A method according to claim 1, further comprising directing the crooked-growth of a log downward by rotating the log in such a direction that the difference between the curvature of the edge line diminishes and the curvature of both the edge lines becomes negative.

4. A method according to claim 1, further comprising bringing the log into the feed plane by moving the top or the base end of the log laterally to the feed plane in such a direction that the difference between the inclinations of the edge line diminishes.

5. A method according to claim 1, further comprising bringing the log into the feed plane by moving both ends of the log at the same speed in the same direction laterally to the feed plane in such direction that the difference between the positions in vertical direction of the edge line diminishes.

6. A method according to claim 1, further comprising interpreting the images of the edge line by dividing the frames from the border to the edge line of the log profile in both cameras in the same way in at least three parts and determining the curvature, inclination, and/or position of the edge lines by the dimensions of these parts.

* * * * *